US007419198B2

(12) United States Patent
Baker et al.

(10) Patent No.: US 7,419,198 B2
(45) Date of Patent: Sep. 2, 2008

(54) ELONGATED MEMBER LIFTING SYSTEM

(75) Inventors: Bryan C. Baker, Houston, TX (US); David W. Clem, Houston, TX (US)

(73) Assignee: Drilltec Patents & Technologie Company, Inc., Houston, TX (US)

( * ) Notice: Subject to any disclaimer, the term of this patent is extended or adjusted under 35 U.S.C. 154(b) by 1020 days.

(21) Appl. No.: 10/133,008

(22) Filed: Apr. 26, 2002

(65) Prior Publication Data

US 2003/0201653 A1 Oct. 30, 2003

(51) Int. Cl.
*B66C 1/18* (2006.01)

(52) U.S. Cl. ..... 294/74; 294/82.13

(58) Field of Classification Search ..... 294/15, 294/31.2, 74, 149, 165, 82.13; 215/396; 16/425; 224/148.6, 250, 257, 901.4; 220/752
See application file for complete search history.

(56) References Cited

U.S. PATENT DOCUMENTS

| | | | | | |
|---|---|---|---|---|---|
| 417,220 | A | * | 12/1889 | Bell | 224/148.7 |
| 609,417 | A | | 8/1898 | Day | 294/74 |
| 646,518 | A | * | 4/1900 | Compton | 215/395 |
| 909,250 | A | | 1/1909 | Starbird | 294/82.13 |
| 991,980 | A | | 5/1911 | Harper | 294/82.13 |
| 1,208,728 | A | * | 12/1916 | Bartlett et al. | 224/148.6 |
| 1,639,786 | A | | 8/1927 | Steinmetz | 294/74 |
| 2,357,182 | A | | 8/1944 | Farmer | 294/74 |
| 2,508,795 | A | | 5/1950 | Nielsen | 294/152 |
| 2,676,835 | A | | 4/1954 | McKinney | 294/74 |
| 2,707,071 | A | * | 4/1955 | Adams | 248/118 |
| 2,774,510 | A | * | 12/1956 | Logan | 294/32 |
| 3,350,129 | A | | 10/1967 | Novak | 294/74 |
| 3,592,502 | A | | 7/1971 | Bolliger | 294/74 |
| 3,606,441 | A | | 9/1971 | Ridgely | 294/78 R |
| 3,701,559 | A | | 10/1972 | Marino et al. | 294/74 |
| 3,820,695 | A | * | 6/1974 | Pecjak | 294/157 |
| 3,840,262 | A | | 10/1974 | Foster et al. | 294/74 |
| 4,092,038 | A | | 5/1978 | Harris | 294/74 |
| 4,126,347 | A | | 11/1978 | Hogue | 294/74 |
| 4,139,179 | A | | 2/1979 | Kukulski | 294/74 |
| 4,239,271 | A | | 12/1980 | Beasley et al. | 294/74 |
| 4,300,608 | A | * | 11/1981 | Cuthbertson | 383/7 |
| 4,336,899 | A | * | 6/1982 | Price, II | 294/27.1 |
| 4,366,938 | A | * | 1/1983 | McSpadden | 294/74 |
| 4,397,493 | A | * | 8/1983 | Khachaturian et al. | 294/81.1 |
| 4,431,226 | A | | 2/1984 | Weilert | 294/150 |
| 4,441,748 | A | | 4/1984 | St. Germain | 294/74 |
| 4,455,718 | A | * | 6/1984 | Finnern | 405/186 |

(Continued)

FOREIGN PATENT DOCUMENTS

| | | |
|---|---|---|
| SU | 235272 | 1/1969 |

(Continued)

*Primary Examiner*—Saul J. Rodriguez
*Assistant Examiner*—Paul T Chin
(74) *Attorney, Agent, or Firm*—Conely Rose, P.C.

(57) ABSTRACT

Methods and apparatus for providing a durable, lightweight lifting member and assembly for use in handling elongated members. One embodiment comprises a cage or net made of a flexible material, the cage or net being adapted to receive one end of an elongated member. Another embodiment is characterized by a flexible lifting member constructed of a pliable, non-metallic material and comprising a body portion, an end portion, and a lifting strap.

8 Claims, 8 Drawing Sheets

U.S. PATENT DOCUMENTS

| | | | | | |
|---|---|---|---|---|---|
| 4,538,849 | A | * | 9/1985 | Khachaturian et al. | 294/81.1 |
| 4,629,153 | A | * | 12/1986 | Marcum | 248/558 |
| 4,718,623 | A | * | 1/1988 | McClure | 248/205.2 |
| 4,736,976 | A | | 4/1988 | Berzenye | 294/82.1 |
| 4,737,069 | A | | 4/1988 | Coblentz | 294/74 |
| 4,804,218 | A | * | 2/1989 | Hilliard | 294/31.2 |
| 4,834,439 | A | | 5/1989 | van de Kamp | 294/74 |
| 4,842,314 | A | | 6/1989 | Bellow | 294/74 |
| 4,856,836 | A | | 8/1989 | Delphin | 294/74 |
| 4,979,659 | A | * | 12/1990 | Boyd | 224/258 |
| 5,147,079 | A | * | 9/1992 | Heather | 294/157 |
| 5,174,481 | A | * | 12/1992 | LeDune | 224/602 |
| 5,259,372 | A | * | 11/1993 | Gross et al. | 128/204.18 |
| D343,293 | S | * | 1/1994 | Montgomery | D3/229 |
| 5,407,110 | A | * | 4/1995 | Marsh, Jr. | 294/149 |
| D378,022 | S | * | 2/1997 | Chen | D3/229 |
| 5,622,346 | A | * | 4/1997 | Story, Jr. | 248/311.2 |
| 5,641,189 | A | * | 6/1997 | Landman | 294/77 |
| 5,688,011 | A | | 11/1997 | Gulley | 294/74 |
| D397,924 | S | * | 9/1998 | Galchutt, Jr. | D3/229 |
| 6,286,798 | B1 | * | 9/2001 | Chun | 248/311.2 |
| 6,331,024 | B1 | | 12/2001 | Gulley | 294/74 |
| 6,352,187 | B2 | * | 3/2002 | Strode | D3/255 |

FOREIGN PATENT DOCUMENTS

| | | |
|---|---|---|
| SU | 466164 | 4/1975 |
| SU | 867839 | 9/1981 |

* cited by examiner

Fig. 18
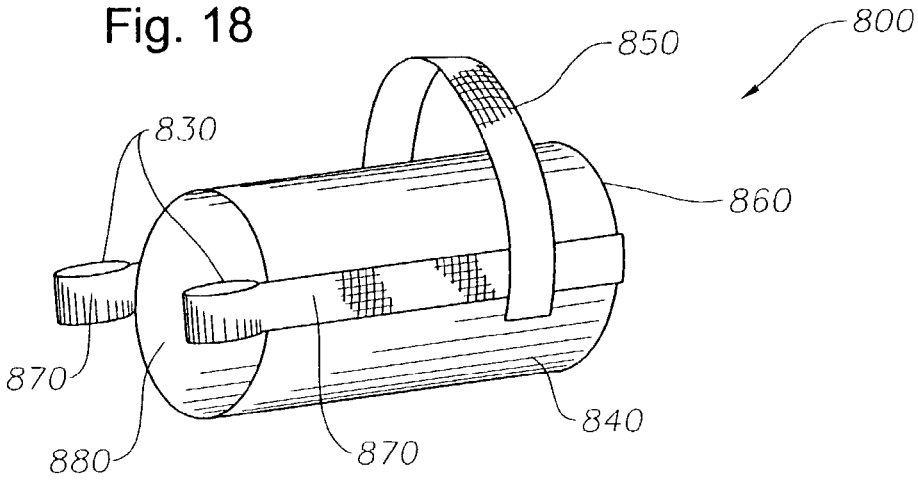
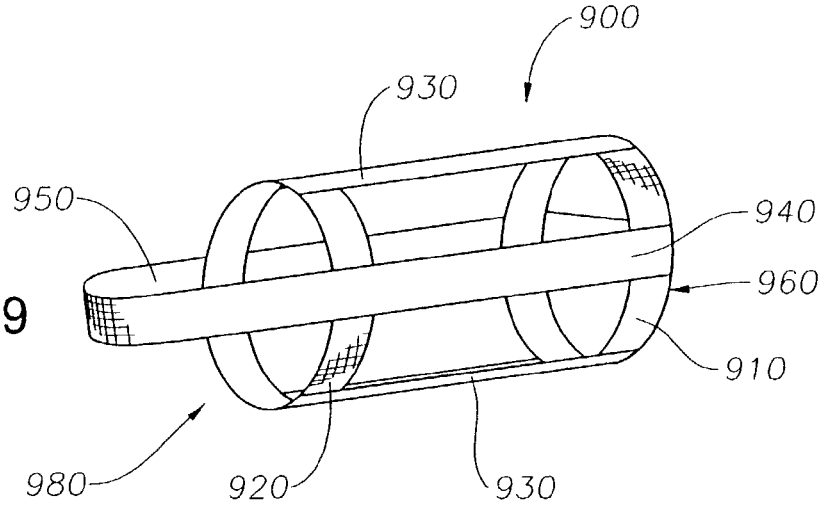
Fig. 19
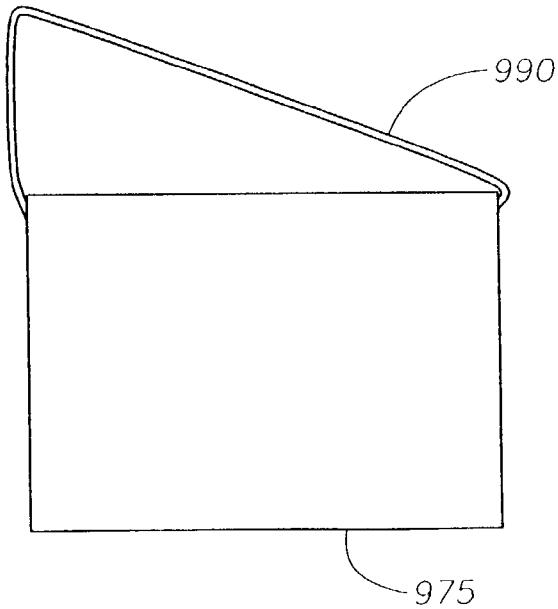
Fig. 20

ELONGATED MEMBER LIFTING SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates generally to methods and apparatus for lifting. More specifically, the present invention relates to methods and apparatus for lifting elongated objects, such as tubing or pipe.

The invention can be used with any type of elongated member made from any material, including solid members such as rods. Additionally, despite being described at times below as related to the oilfield and drilling industry, the invention is not so limited and can be used in any industry.

The drilling and production of hydrocarbon wells involves the use of large quantities of tubing, including pipe as a component of a drillstring and casing used to line the well. Normally, this tubing is available in sections of twenty to forty feet in length. These individual sections are then connected together to form the drillstring or casing tubing. A standard hydrocarbon well drilled on land may employ thousands of feet of drill pipe and tubing, requiring thousands of individual joints of tubing and pipe to be handled while drilling the well. An deep water offshore well may require considerably more pipe or tubing.

The individual sections of tubing are normally transported from a fabrication facility to the well site by truck or supply boat. The tubing must then be moved from the truck or boat to the drilling rig in a safe and secure manner. Some tubulars, such as pipe, have threaded pin ends and box ends, which help prevent the pipe from being damaged during transport. Because of the large number of tubulars used in drilling a well, the handling of these tubulars is of great concern in the operation of a drilling rig.

One method utilized in handling tubulars has been simply to use a harness or sling to wrap around the tubular in a "choker" configuration and lift the tubular by the sling. Lifting from a single point lift, as described above, requires a great deal of effort in properly locating the lift point near the center of mass of the tubular so that the tubular remains balanced during the lift. This method is not favored because of the inherent risk to men and material should the tubular not be lifted in a balanced manner.

Another method involves using a lifting appliance having hooks that are designed to grasp into the ends of a tubular. The hooks are typically connected via wires to a centralized lifting point. These hooks are inserted into the open ends of a tubular and bear against its inside surface. This type of lifting hook has been known to cause damage to the tubular interior or threaded connections, particularly when the interior of the tubular is coated. If damaged, the tubular often has to be trimmed down to remove the damaged area.

Another method involves metal end caps placed over each end of the tubular. The caps are typically connected via wires to a centralized lifting point. These metal end caps commonly have an elongated body with a solid plate attached to one end. Attached to the body is a lifting lug that can then be coupled to a central lifting point. These metal end cap assemblies surround the entire end portion of the tubular and prevent the damage often caused by lifting hooks. One drawback of these metal end cap assemblies is their weight, especially for larger diameter pipe. The heavier the end cap, the more difficult to handle. Another drawback with such assemblies is they allow metal to metal contact with the pipe, which can damage the pipe. Metal lifting appliances are also subject to corrosion and maintenance problems, especially in offshore applications.

Additionally, a general problem in pipe lifting is the requirement by some drilling contractors that the thread protectors on the ends of the tubular be "non-liftable." This requirement stems from the fact that many present lifting devices, such as lifting hooks, damage the interior of the tubular. Accordingly, thread protector manufacturers needed to design and manufacture a protector that prevented such damage. This was accomplished by sealing the end of the protector, in some instances with a cover (such as a metal plate), so that lifting hooks could not be inserted into the interior of the pipe. This increases the costs of protectors and, more importantly, cannot guarantee that personnel handling the pipe will not break open through the cover and insert a lifting hook. Applicants' invention obviates the need for a "non-liftable" protector and ensures that the interior of the pipe is not damaged during the lifting process.

Thus, there remains a need in the art for methods and apparatus for safely and efficiently lifting tubulars, or other objects, in a manner that does not damage the tubular or object. Therefore, the embodiments of the invention are directed to methods and apparatus that seek to overcome these and other limitations of the prior art.

SUMMARY OF THE PREFERRED EMBODIMENTS

Accordingly, there is provided herein methods and apparatus for providing a durable, lightweight lifting assembly for elongated members. In general, a preferred embodiment is characterized by a tubular lifting member constructed of a pliable, non-metallic material.

One embodiment comprises a cage or net made of a flexible material, the cage or net being adapted to receive one end of an elongated member.

In another embodiment, the body portion of the assembly is constructed from a continuous piece of pliable, non-metallic material formed into an elongated section. Two axial straps couple to the outside of the elongated section, crossing over one end of the elongated section to form a terminal end. A lifting strap also couples to the elongated section and forms a means for connecting to a lifting apparatus.

Another embodiment includes a tubular body portion constructed from at least two rings connected by at least one axial strap, but preferable a plurality of axial straps. The axial strap forms the terminal end of the body portion and limits the axial movement of the assembly once it is placed on a tubular. A lifting strap couples to the rings and provides a means for connecting to a lifting apparatus. The assembly is constructed from a pliable, non-metallic material that, preferably, is stitched together using heavy thread.

The invention is not limited to the foregoing embodiments, but rather such embodiments, as well as those discussed below, are merely exemplary. The invention comprises a combination of features and advantages that enable it to safely and securely provide a lifting system for use in handling tubulars or other elongated members, such as pipe. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a more detailed understanding of the preferred embodiments, reference is made to the accompanying Figures, wherein:

FIGS. 18 and 19 are perspective views of flexible lifting members showing alternative embodiments of a lifting strap;

FIG. 20 is an elevational side view of a flexible lifting member coupled to a lifting link;

DETAILED DESCRIPTION OF THE PREFERRED EMBODIMENTS

Figure 1:
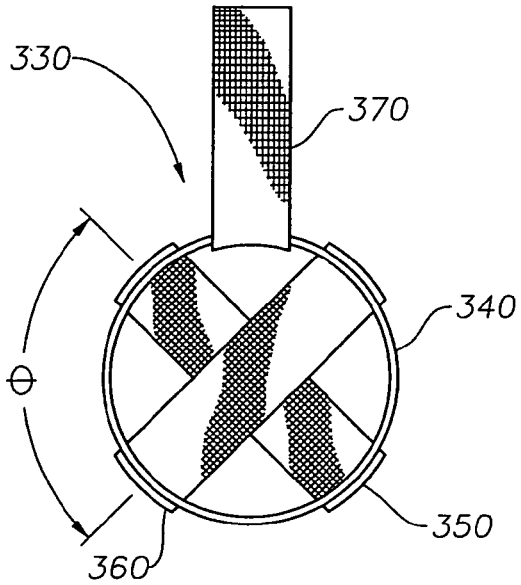
FIG. 1 is a front elevational view of one embodiment of a flexible lifting member.

In the description that follows, the drawing figures are not necessarily to scale. Certain features of the invention may be shown exaggerated in scale or in somewhat schematic form and some details of conventional elements may not be shown in the interest of clarity and conciseness.

There are shown in the drawings, and herein will be described in detail, certain embodiments of the invention with the understanding that the disclosure is to be considered an exemplification of the principles of the invention, and is not intended to limit the invention to that illustrated and described herein. The embodiments of the invention relate to methods and apparatus for providing a connection between the end of a tubular and a lifting apparatus. The invention is susceptible to embodiments of different forms. In particular, various embodiments of the invention provide a number of different methods and apparatus for safely and securely lifting a pipe, but may also find utility in lifting other items, especially elongated items. It will be appreciated that the embodiments described below refer to the lifting of pipe, but that those embodiments can be similarly used to lift tubulars or other elongated members in general.

Figure 2:
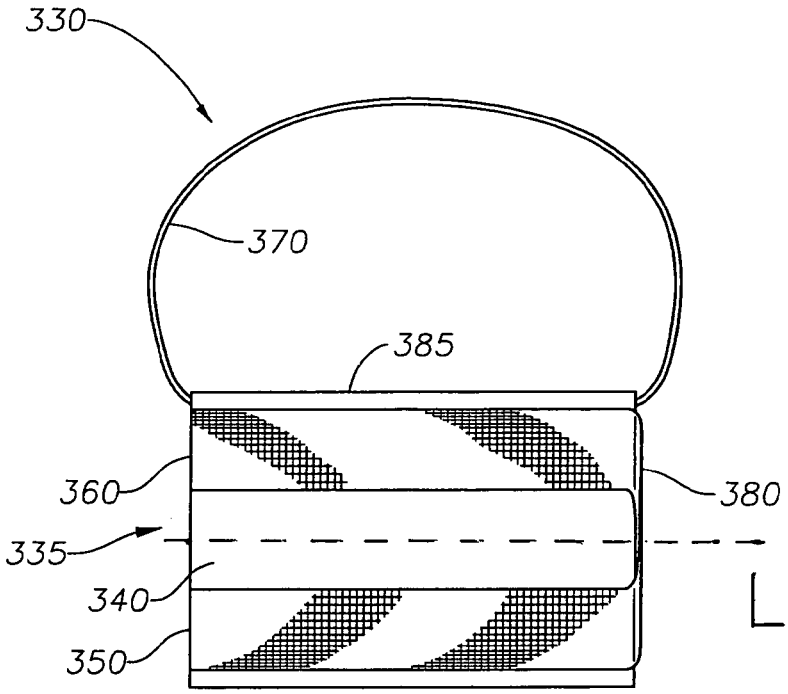
FIG. 2 is a side elevational view of the open end of the lifting member of FIG. 1.

In general, the flexible lifting member of the invention is a cage or net like member. Referring now to FIGS. 1 and 2, an embodiment of a flexible lifting member 330 is shown. Flexible lifting member 330 generally includes a continuous tubular body 340, the body 340 having a longitudinal central axis L, as shown in FIG. 2. Tubular body 340 is preferably of sufficient length to prohibit, or substantially limit, the pipe end from coming out of body 340 while the pipe is being lifted. Flexible lifting member 330 preferably further includes axial straps 350, 360 and lifting strap 370. Preferably, axial straps 350 and 360 are coupled to the length of body 340 and are spaced at approximately 90°, as shown by angle θ in FIG. 1. Straps 350, 360 cross over one end of body 340 to form terminal end 380. Tubular body 340 is preferably formed from a single piece of pliable, non-metallic material with the ends of the material coupled at joint 385. Axial straps 350 and 360 may be attached to each other at terminal end 380.

Figure 21:
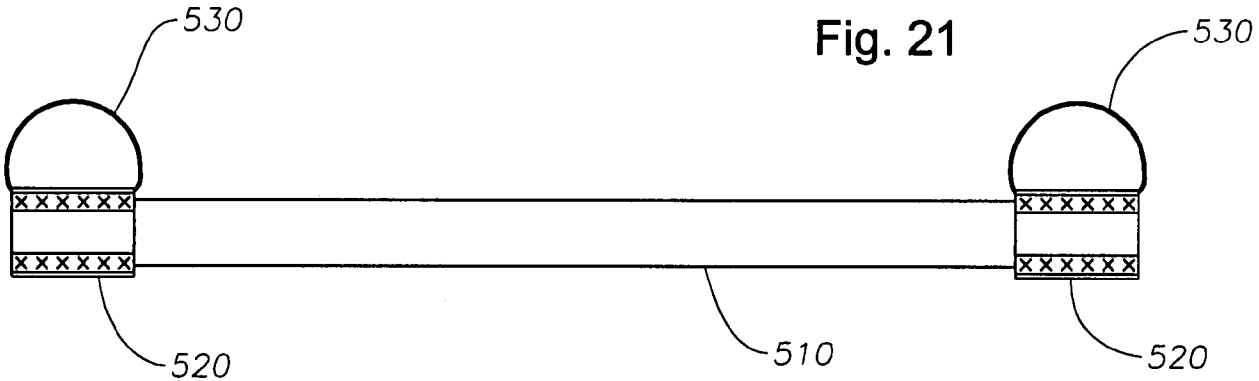
FIG. 21 is an elevational side view of flexible lifting members installed on a pipe.

Lifting strap 370 couples to body 340 and allows lifting member 330 to be coupled by a line to a lifting apparatus (as shown in FIG. 21), such as a crane, that physically lifts the pipe. Preferably, lifting strap 370 is coupled to the inside of tubular body 340 directly below joint 385. Thus, when a lifting force is exerted on strap 370, strap 370 pulls against joint 385 as opposed to pulling against the coupling holding strap 370 to lifting member 330. This provides greater rigidity at the primary lift axis. Lifting strap 370 forms a means for connecting lifting member 300 to a lifting apparatus.

The components of lifting member 330 are preferably constructed of a lightweight, pliable, non-metallic material, as detailed below. Axial straps 350, 360 and lifting strap 370 are preferably coupled to body 340 by sewing or stitching, but can also be coupled to body 340 by gluing or other methods.

Figure 3:
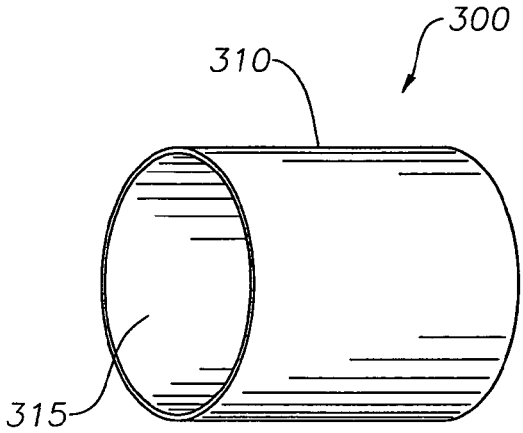
FIG. 3 is a perspective view of an embodiment of an insert.
Figure 4:
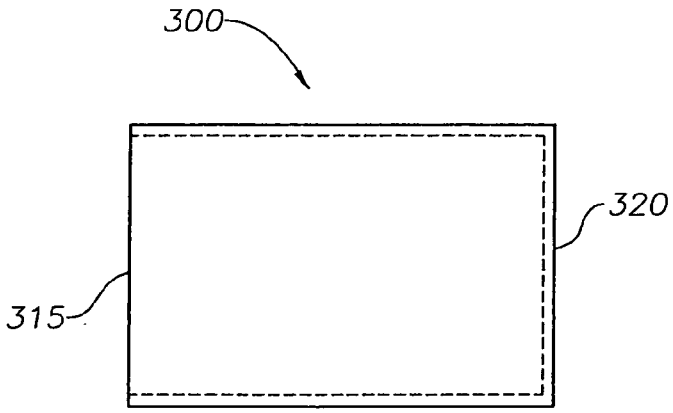
FIG. 4 is a side elevational view of the insert of FIG. 3.

Referring now to FIGS. 3 and 4, an embodiment of insert 300 is shown. Insert 300 is preferably constructed from a lightweight, solid non-metallic material, such as polyethylene, polyvinlchloride, polypropylene, Teflon, or plastic, and has a cylindrical wall 310, an open end 315, and a closed end 320.

Figure 5:
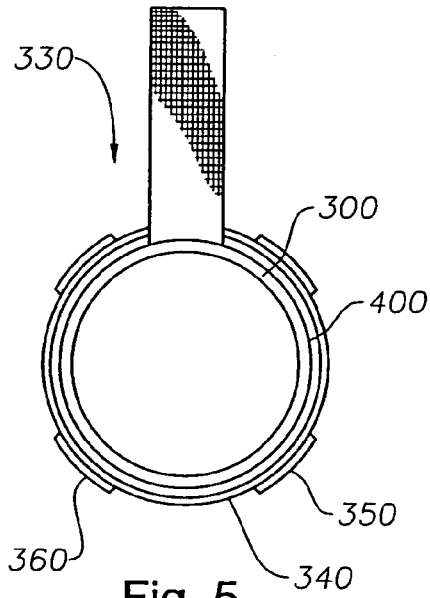
FIG. 5 is a side elevational view of the lifting member of FIGS. 1 and 2 with an insert installed.
Figure 6:
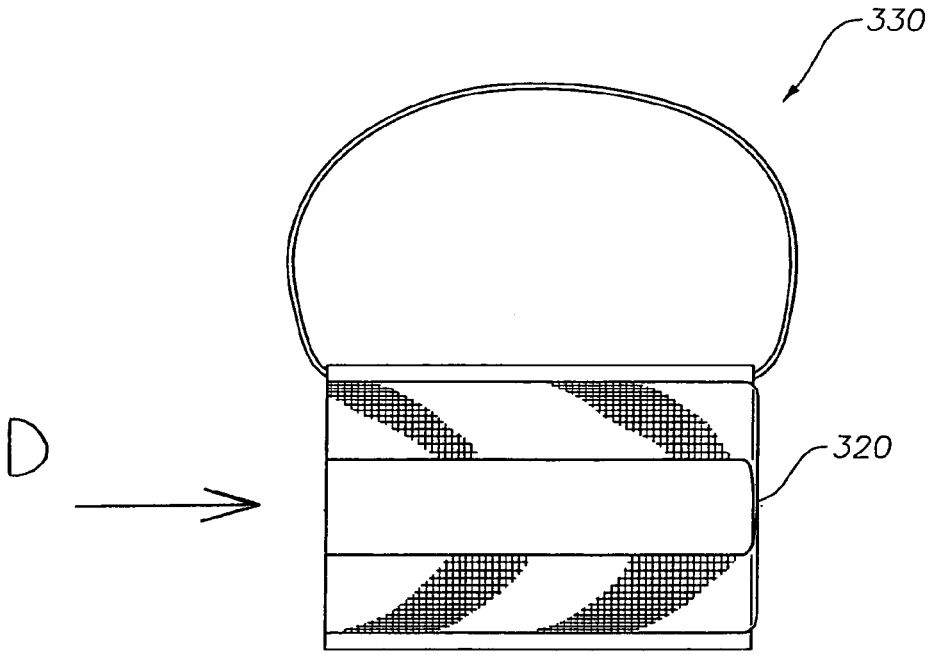
FIG. 6 is a side elevational view of the lifting member of FIGS. 1 and 2 with an insert installed.

Referring now to FIGS. 5 and 6, although flexible lifting member 330 can be used alone, preferably member 330 is used in connection with insert 300. The direction of receiving tubulars and pipes into the flexible lifting member 330 (and others embodiments thereof) is shown by arrow D in FIG. 6. Insert 300 may be free to rotate within, or may be attached to, flexible lifting member 330 and provides free rotation of a pipe end within insert 300. Insert 300 provides a wear surface for contacting a pipe during lifting that serves to protect body 340 and straps 350 and 360.

Insert 300 serves as a wear surface that protects flexible lifting member 330. Additionally, insert 300 preferably provides a low friction surface. Thus, if flexible lifting member 330 is positioned such that strap 370 is not on the upper side of the pipe, insert 300 allows member 330 to rotate or twist about the longitudinal axis of the pipe when the lifting apparatus begins to lift the pipe. Insert 300 also allows the pipe end to slide more easily toward terminal end 380 of lifting member 330.

Figure 7:
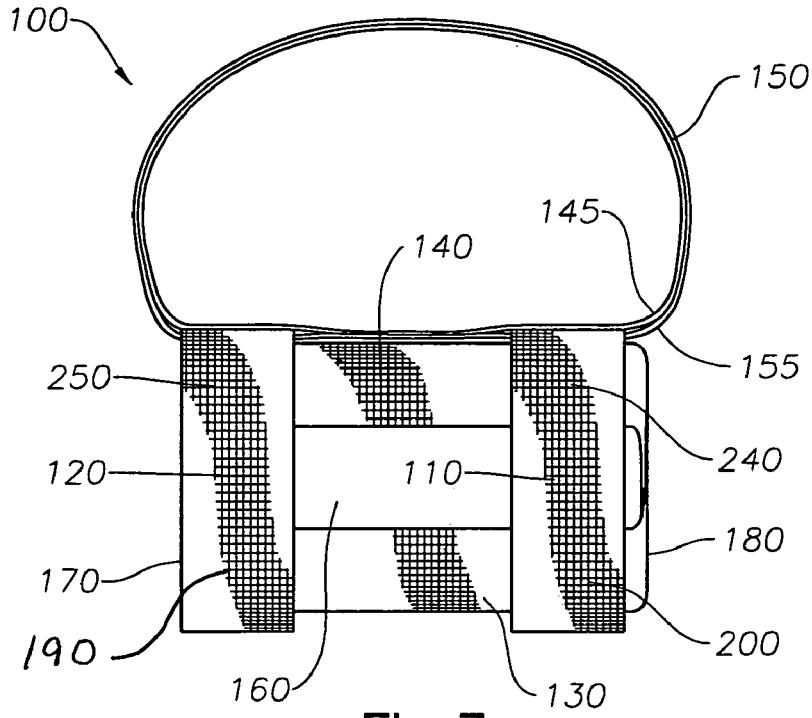
FIG. 7 is a side elevational view of another embodiment of a flexible lifting member.
Figure 8:
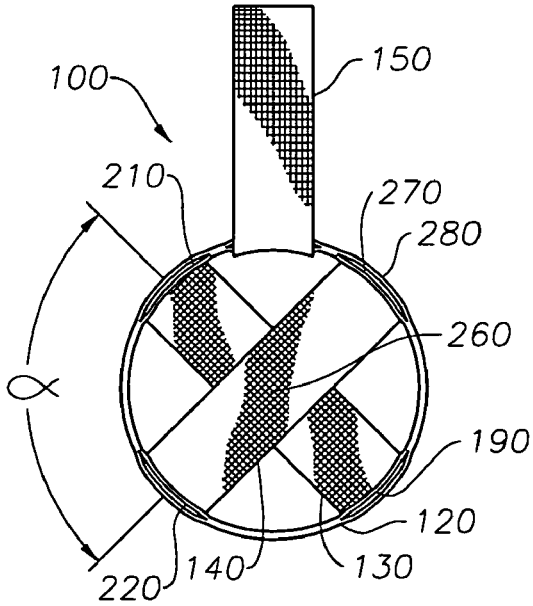
FIG. 8 is a front elevational view of the lifting member of FIG. 7.

Turning next to FIGS. 7 and 8, an elevational view of another embodiment of a flexible lifting member 100 is shown. Flexible lifting member 100 generally includes front ring 120 and back ring 110, which are connected by axial straps 130 and 140. Rings 120, 110 are preferably substantially circular and have a circumference greater than the outer diameter of the pipe. Rings 110 and 120 and straps 130 and 140 combine to form a tubular body 160 having an open end 170 and a terminal end 180. Straps 130 and 140 form terminal end 180 to prevent the pipe from passing through terminal end 180. As explained in detail below, flexible lifting member 100, including rings 110, 120 and straps 130, 140, is preferably made from a lightweight, pliable, non-metallic material having sufficient strength and durability for lifting pipe. Tubular body 160 is preferably of sufficient length to prohibit, or dramatically minimize, the pipe from slipping or rotating out of body 160 during the lifting of the pipe. It will be appreciated that the invention is not limited to two axial straps 130, 140, but may have a single axial strap or any plurality of axial straps. For example, axial straps 130, 140 each may be continuous and extend from front ring 120 to back ring 110, form terminal end 180, and extend on the other side of member 100 to front ring 120. It will be further appreciated that the invention is not limited to two rings 110, 120, but may have any plurality of rings.

Strap 130 is preferably coupled to a first point 190 on front ring 120, to a second point 200 on back ring 110, to a third point 117 (not shown) on back ring 110 that is approximately 180° opposed to second point 200, and to a fourth point 210 on front ring 110 that is approximately 180° opposed to first point 190. Similarly, strap 140 is preferably coupled to a first point 220 on front ring 120, to a second point 230 (not shown) on back ring 110, to a third point 240 on back ring 110 that is approximately 180° opposed to second point 230, and to a fourth point 250 on front ring 120 that is approximately 180° opposed to first point 220. Straps 130 and 140 may also be coupled to each other at crossing point 260. Strap 130 and strap 140 are preferably spaced such that they are approximately 90° from one another, as shown by angle $\alpha$ in FIG. 8.

Front ring 120 and back ring 110 are preferably constructed from two layers of material, an inner layer 270 and outer layer 280. Inner layer 270 and outer layer 280 are preferably made from the same material, but may be made from differential materials. Preferably, straps 130 and 140 are disposed between inner layer 270 and outer layer 280.

Lifting strap 150 is coupled to tubular body 160 and is preferably constructed from two layers of material, an inner layer 145 and an outer layer 155. Preferably, rings 110 and 120 are disposed between inner layer 145 and outer layer 155. Lifting strap 150 allows flexible lifting member 100 to be connected to a lifting apparatus, such as a line (FIG. 22) connected to a crane, that physically lifts the pipe. Various connection mechanisms are well known in the art. Lifting strap 150 forms a means for connecting lifting member 100 to a lifting assembly. Inner layer 270 and outer layer 280 of rings 110, 120 can preferably be coupled to one another and/or other material on flexible lifting member 100 by sewing or stitching, but can also be coupled by gluing or other methods. Similarly, inner layer 145 and outer layer 155 of strap 150 can preferably be coupled to one another and/or other material on flexible lifting member 100 by sewing or stitching, but can also be coupled by gluing or other methods.

Figure 9:
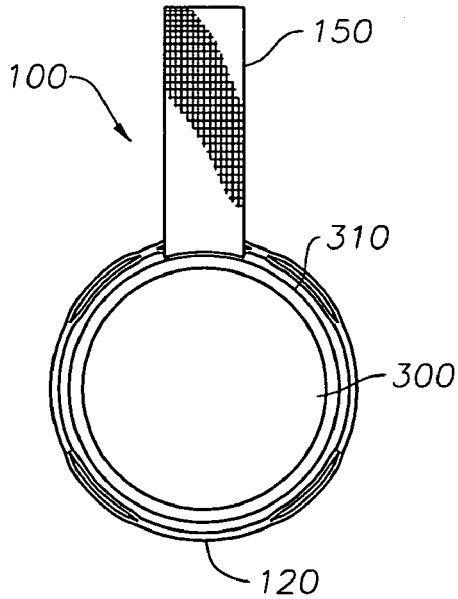
FIG. 9 is a front elevational view of the lifting member of FIG. 7 with an insert installed.
Figure 10:
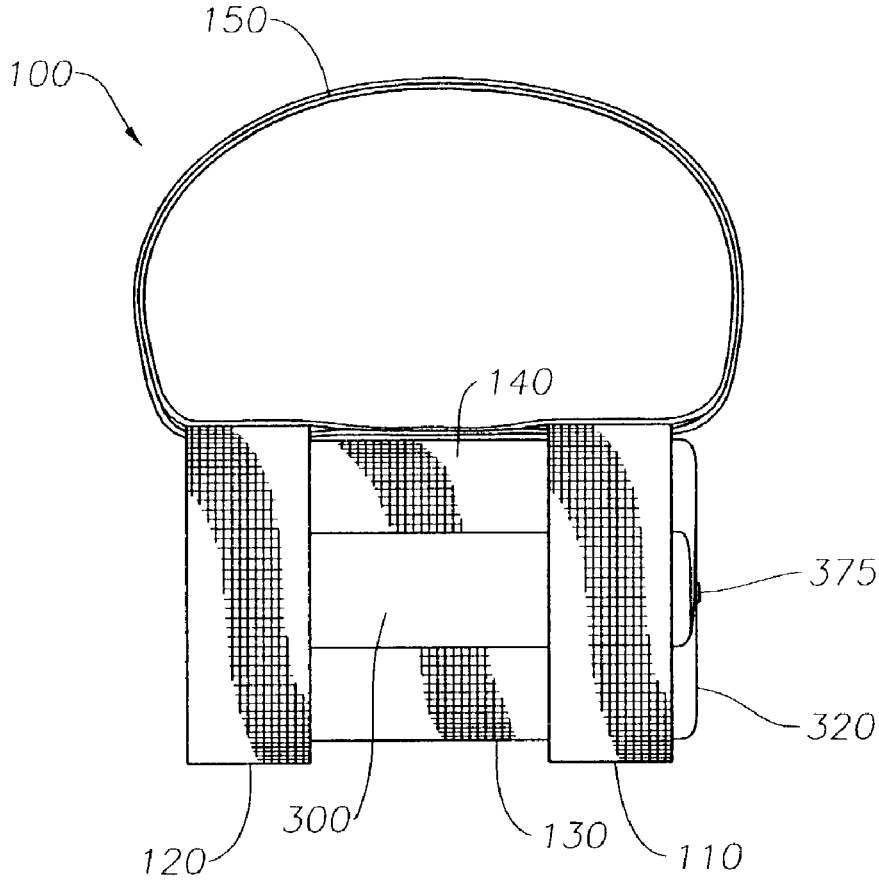
FIG. 10 is a side elevational view of the lifting member of FIG. 8 with an insert installed.

Although lifting member 100 is strong enough to be used alone, preferably member 100 is used in connection with insert 300, as shown in FIGS. 9 and 10. Insert 300 may be free to rotate within flexible lifting member 100 and allows rotation of a pipe within the insert. Alternatively, insert 300 can be coupled to lifting member 100. This may be desired because, after many lifts, lifting member 100 will expand, thus tending to lose any tight fit between lifting member 100 and insert 300. One method for coupling lifting member 100 and insert 300 is by placing a non-metallic fastener, such as nylon rivot 375, through portions of straps 130, 140 located at terminal end 180, as shown in FIG. 10. Lifting member 100 and insert 300 can be coupled at one or more different points.

Figure 11:
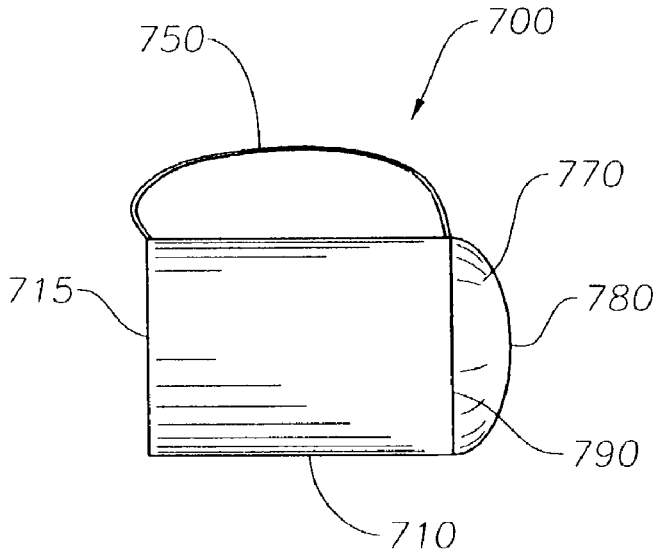
FIG. 11 is a side elevational view of another embodiment of a lifting member.
Figure 12:
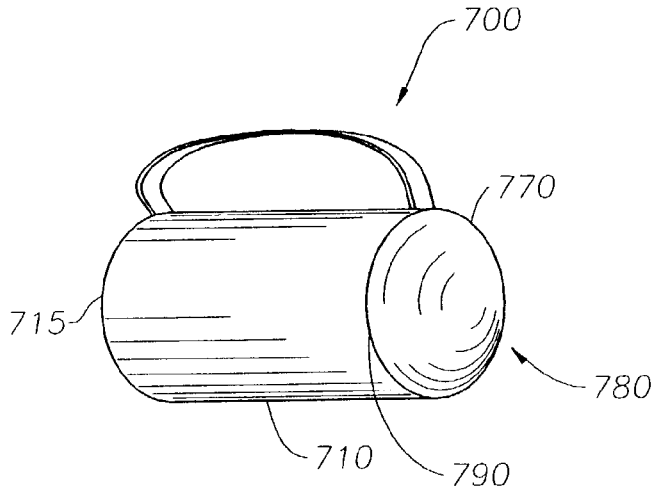
FIG. 12 is a rear perspective view of the lifting member of FIG. 11.

Referring now to FIG. 11, another embodiment of flexible lifting member 700 is shown. Lifting member 700 has a body 710, an open end 715, and terminal end 780. Additionally, strap 750 is disposed on lifting member 700. Cap 770 forms terminal end 780. Cap 770 is preferably made from a lightweight, pliable, non-metallic material as described below and is preferably coupled to body 710 at seam 790, which traverses the circumference of body 710. As shown in FIG. 12, cap 770 completely covers terminal end 780. Cap 770 can be used in lieu of, or in addition to, axial straps, for example straps 130, 140 or straps 350, 360. Additionally, cap 770 can be use at the end of any flexible lifting member of the invention.

Figure 13:
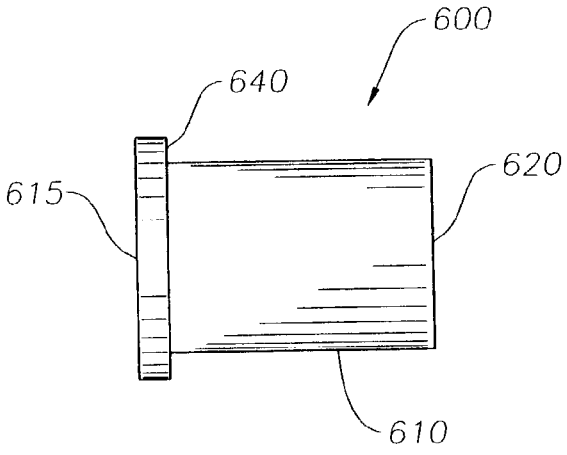
FIG. 13 is a side elevational view of another embodiment of an insert.
Figure 14:
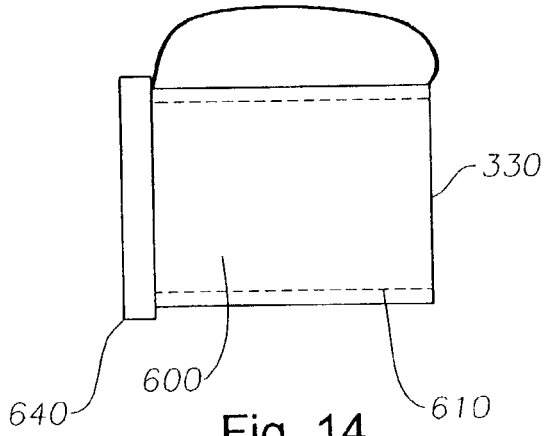
FIG. 14 is a side elevational view of an embodiment of a lifting member with an insert installed.

Turning next to FIGS. 13 and 14, another embodiment of insert 600 is shown. Insert 600 comprises a body 610 having an open end 615 a closed end 620, and a bumper 640. When insert 600 is within a flexible lifting member, such as member 330, bumper 640 abuts body 340 at open end 335. Bumper 640 can assist straps 350, 360 in holding insert 600 in lifting member 330. Additionally, insert 600 may be used if a flexible lifting member does not have at least a partially closed terminal end. In such configuration, a flexible lifting member may have two open ends, as shown in FIG. 14.

Figure 15:
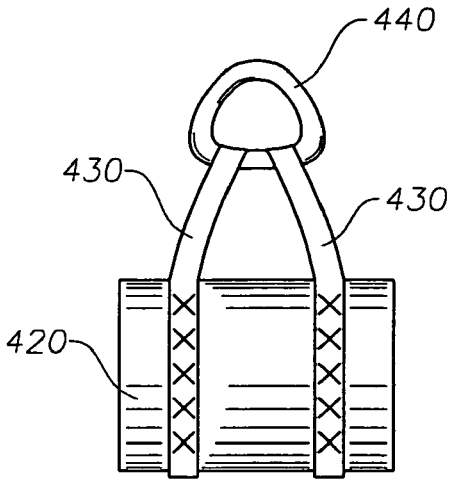
FIGS. 15-17 are elevational views of flexible lifting members showing alternative embodiments of a lifting strap.
Figure 16:
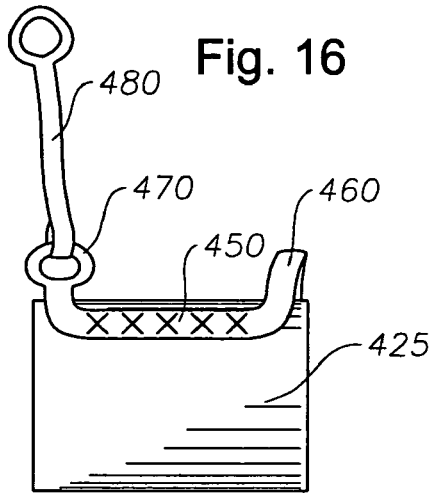
Figure 17:
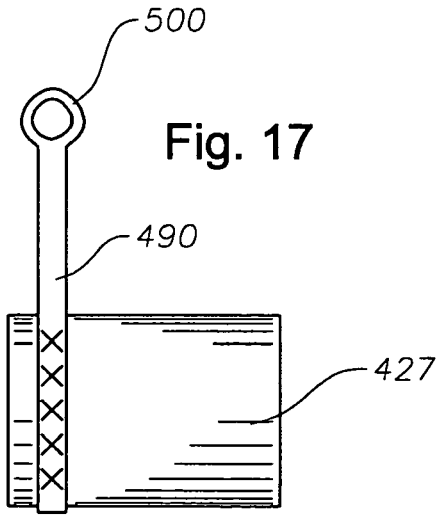

Turning next to FIGS. 15-17, alternative arrangements of lifting straps are shown. FIG. 15 shows a flexible lifting member 420 with two separate lifting straps 430 coupled radially around member 420 and also attached to a lifting eye 440. FIG. 16 shows another lifting member 425 having an axial lifting strap 450 with a handling loop 460 on one end and a lifting loop 470 on the opposite end. A secondary lifting strap 480 may be coupled to lifting loop 470. FIG. 17 shows another lifting member 427 with a radially attached lifting strap 490 having a lifting loop 500 at the end. It is understood that there are many different arrangements of lifting straps and flexible lifting members that may be utilized without departing from the scope of the invention. The embodiments shown in FIGS. 15-17 preferably utilize an insert, such as insert 300 or 600.

Referring now to FIGS. 18 and 19, two more embodiments of lifting straps are shown. As shown in FIG. 18, flexible lifting member 800 comprises a body 840, which has an open end 880 and a terminal end 860. Strap 870 extends axially along one side of body 840, around terminal end 860, and axially along the other side of body 840. Lifting loops 830 are formed from strap 870 adjacent open end 880. Lifting Loops 830 can connect to a lifting apparatus. Lifting member 800 may further comprise a handle 850 that can be coupled to body 840.

Turning next to FIG. 19, flexible lifting member 900 is shown having a first end 980 and a second end 960. Lifting member 900 comprises a first circumferential strap 920, a second circumferential strap 910, a first longitudinal strap 940, and a second longitudinal strap 930. Longitudinal strap 940 includes lifting loop 950. Lifting loop 950 is capable of being coupled to a lifting mechanism and forms a means for connecting lifting member 900 to a lifting apparatus. Longitudinal straps 940 and 950 preferably intersect and couple at second end 960, partially closing second end 960.

Referring now to FIG. 20, flexible lifting member 975 is coupled to lifting link 990. Lifting link 990 is not limited to the shape shown in FIG. 20 and lifting link 990 can be made from any material, including but not limited to a metal. When lifting link 990 is made from metal, lifting link 975 is preferably disposed on flexible lifting member 975 so as not to contact, and thus possibly scratch, the outside of the pipe.

Lifting link 990 can be used with any embodiments of the flexible lifting members disclosed herein and any other embodiments within the spirit of the invention.

Referring now to FIG. 21, a lifting arrangement for use with flexible lifting member is shown. Flexible lifting members 520 are used generally to represent any and all embodiments of the flexible lifting member within the spirit of this invention, including but not limited to flexible lifting members 100, 330, 420, 800, and 90. Lifting members 520 are placed on the ends of pipe 510. If inserts, such as inserts 300 and 600, are being used, such inserts are preferably place in lifting members 520 before lifting members 520 are placed on the ends of pipe 510. However, the inserts may be placed on the pipe first and the lifting members 520 be placed over the inserts. Lifting straps 530 on either end of pipe 510 provide attachment points for lifting the pipe with a crane or other lifting apparatus. Lifting straps 530 provide locations for straight lifts, using a spreader bar, or for lifting from a single centralized lifting point. Lifting members 520 are preferably sized so as to fit on the ends of pipe 510 without having to remove any protective pipe caps or thread protectors that may be installed. Lifting members 520 may be used in conjunction with other lifting members attached to a single lifting apparatus for lifting multiple pipes at one time.

Figure 22:
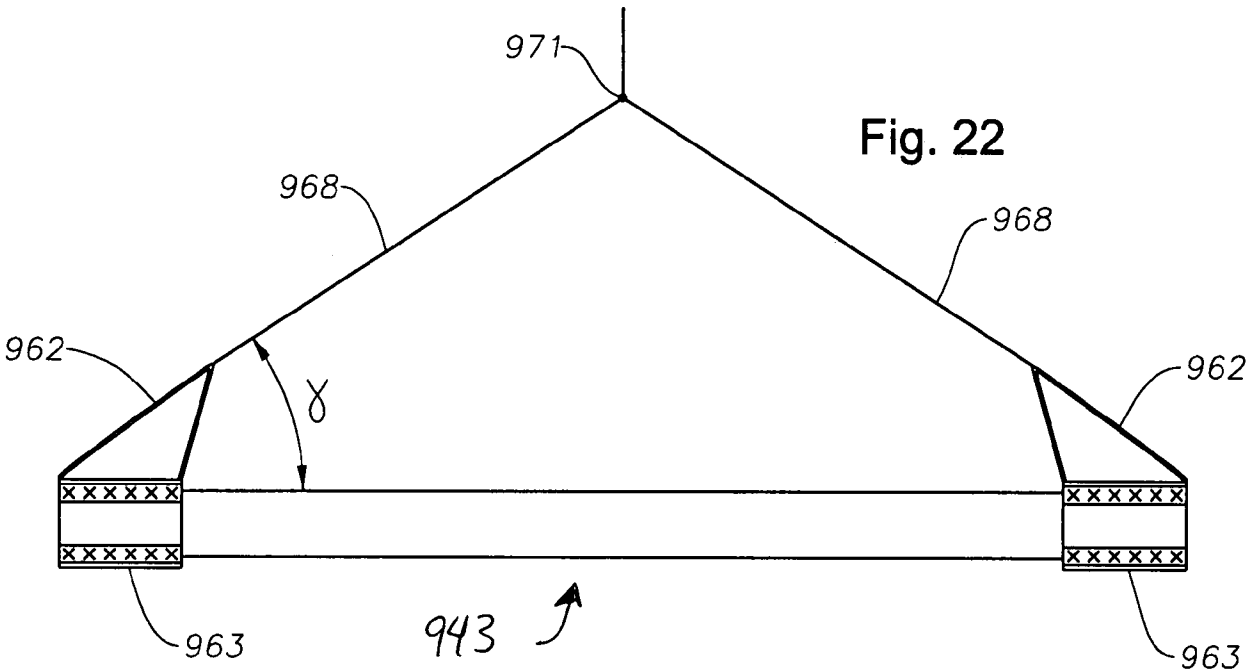
FIG. 22 is an elevational side view of an embodiment of a lifting assembly.

Turning next to FIG. 22, an embodiment of a lifting assembly 943 is shown. Assembly 943 comprises flexible lifting members 963 and line 968. Members 963 can be any embodiment of the flexible lifting members or the invention, including any cage or net like member such as members 100, 330, 420, and 520. Line 968 can be a continuous line or be two separate items joined at point 971. Line 968 can be a wire, cable, rope, or chain, but can also be made from flexible material. The means for connecting to a lifting apparatus allows angle γ (FIG. 22) to vary greatly.

It is preferred that a single lifting member size be able to service pipe within a certain range, which is generally two to twenty inches. Additional, custom sizes can be made. For example, different size lifting members may be provided for pipe ranging between 2⅛" and 4½", between 5" and 7", between 7⅝" and 9⅞", and between 10¾" and 13⅜". Sizes above 13⅜" are possible, but the design of the lifting member will be heavily dependent on the specific loading conditions. It is preferred that a flexible lifting member serving a range of pipe sizes be designed to handle the heaviest pipe manufactured within that range, including a reasonable safety factor.

The embodiments of the flexible lifting member of the invention, including lifting members 100, 330, 420, and 520 and their rings, straps, loops, and handles, are preferably constructed of a lightweight, pliable, non-metallic material having sufficient strength and durability characteristics. It is also preferred that the pliable, non-metallic material be non-magnetic. Preferably, woven materials such as nylon, polyester, or a combination or mixture of nylon and polyester may be used. These materials allow each pair of lifting members to be rated at between 2,500-9,800 lbs., stitched together with a minimum of five stitches per inch using size 207-3 cord thread. Additionally, other materials, such as kevlar or other high strength materials, may be used. These materials can be combined or mixed or can be combined or mixed with nylon and/or polyester. The material can be joined by stitching with a high strength thread, such as size 207-3 chord nylon thread. The pliable material has the added benefit of being corrosion resistant and easy to maintain, as compared to metallic lifting aids.

The embodiments of the insert of the invention, including inserts 300 and 600 disclosed herein, are preferably constructed from polyethylene or another non-metallic polymeric materials, such as polyvinylchloride, polypropylene, Teflon, or plastic. Notwithstanding that it may damage the exterior of the elongated member and/or may result in metal-to-metal contact, the insert of the invention can also be made from metal or metallic material.

The flexible lifting members of the invention can be formed from one or more section of material. When that material is cut to form the lifting members, including the straps, rings, and handles therefor, it is preferably to heat the ends of the material to prevent the material from fraying.

As used herein and in the claims, the "means for connecting" to a lifting apparatus includes all embodiments of the lifting straps, loops, handles, and/or lifting links described herein and other lifting straps, loops, handles, and/or lifting links within the spirit of the invention.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. A system for lifting an oilfield tubular having an end, comprising:

a body having a first end, a second end, and a longitudinal axis running therebetween, said longitudinal axis of said body being substantially horizontal when the oilfield tubular is being lifted by said flexible member;

said first end of said body configured to received the end of the oilfield tubular;

said second end configured to prevent axial movement of the end of the oilfield tubular;

a lifting strap attached proximate to said first end of said body and attached proximate said second end of said body and thereby forming a loop that lies in a plane that is substantially parallel to said longitudinal axis of said body, said lifting strap forming an acute angle with said longitudinal axis of said body when the oilfield tubular is being lifted by said flexible member;

an insert being disposed in said body and having a first end, a second end, an opening, said insert extending from said first end of said body to said second end of said body; and wherein said body and lifting strap are constructed of a pliable material; and wherein said system is capable of lifting approximately 1,250 lbs.

2. The system of claim 1, wherein said body further comprises:

a first axial strap bisecting said second end; and a second axial strap bisecting said second end substantially perpendicular to said first axial strap.

3. The system of claim 2, wherein said insert is selected from the group consisting of polyethylene, polyvinylchloride, polypropylene, and Teflon.

4. The system of claim 1, wherein said body comprises at least two vertical rings spaced horizontally apart and connected by said axial straps.

5. The system of claim 1, wherein said body comprises a continuous body member having an outside portion and at least one axial strap attached to said outside portion.

6. The system of claim 1, wherein said pliable material is selected from the group consisting of nylon, polyester, and Kevlar.

7. The system of claim 1, wherein said pliable material is a mixture of one or more of nylon, polyester, or Kevlar.

8. The system of claim 1, wherein said lifting strap is attached to said body by stitching.

* * * * *